US006715470B2

(12) United States Patent
Takahashi

(10) Patent No.: US 6,715,470 B2
(45) Date of Patent: Apr. 6, 2004

(54) FUEL SUPPLY DEVICE FOR AN INTERNAL COMBUSTION ENGINE

(75) Inventor: Tatsuhiko Takahashi, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/180,302

(22) Filed: Jun. 27, 2002

(65) Prior Publication Data

US 2003/0127082 A1 Jul. 10, 2003

(30) Foreign Application Priority Data

Jan. 9, 2002 (JP) ..... 2002-002322

(51) Int. Cl.[7] ..... F02M 37/06; F02M 69/16
(52) U.S. Cl. ..... 123/458
(58) Field of Search ..... 123/457, 458, 123/497, 506, 511, 512

(56) References Cited

U.S. PATENT DOCUMENTS 6,450,147 B2 * 9/2002 Demura et al. ..... 123/458
6,539,922 B2 * 4/2003 Sakai et al. ..... 123/458
6,581,574 B1 * 6/2003 Moran et al. ..... 123/497

FOREIGN PATENT DOCUMENTS

JP 11-324757 11/1999

* cited by examiner

*Primary Examiner*—Tony M. Argenbright
(74) *Attorney, Agent, or Firm*—Sughrue Mion, PLLC

(57) ABSTRACT

Disclosed is a fuel supply device for an internal combustion engine, which is capable of preventing fuel pressure control problems caused by divergence of a feedback control amount in pump control. A target fuel pressure is computed, and a pump discharge quantity is computed as a feed forward quantity in accordance with an amount of change in the target fuel pressure. A determination is made as to whether or not the feed forward quantity is zero, and when the feed forward quantity is zero, a feedback correction quantity is computed based on the target fuel pressure and the actual fuel pressure, and feedback control is performed. In the case where the feed forward quantity is not zero, the computation of the feedback correction quantity is stopped and the feed forward control is continued.

7 Claims, 13 Drawing Sheets

12 : TARGET FUEL PRESSURE (FPT)
13 : ACTUAL FUEL PRESSURE (FPD)
14 : FEED FORWARD QUANTITY (QFF)

FUEL SUPPLY DEVICE FOR AN INTERNAL COMBUSTION ENGINE

CROSS REFERENCE TO RELATED APPLICATION

This application is based on Application No. 2002-002322, filed in Japan on Jan. 9, 2002, the contents of which are hereby incorporated by reference.

BACKGROUND OF THE INVENTION

1. Field of the Invention

The present invention relates to a fuel supply device for an internal combustion engine, and more particularly to a fuel supply device for an internal combustion engine, which supplies fuel while controlling the pressure of the fuel supplied to the internal combustion engine.

2. Description of the Related Art

An example of a conventional fuel supply device for an internal combustion engine is disclosed in Japanese Patent Application Laid-open No. 11-324757. In this fuel supply device, a target fuel pressure and the detected fuel pressure are used to set a feedback quantity, and the pump discharge quantity which corresponds to the target fuel pressure change amount, and the fuel quantity that is supplied to the engine by a fuel injection valve, are set as a feed forward quantity.

Explanation will now be made of the construction and operation of the conventional fuel supply device, using FIG. 1. A feed pump 102 draws fuel up from a fuel tank 101. Fuel which has passed through a filter 103 is pressure-regulated by a regulator 104 and introduced into a high-pressure pump 105. A piston 107 moves up and down by means of a pump cam 112, which rotates as a single unit with a cam shaft for an air intake or exhaust valve. As a result, the volume of a pressure chamber 118 changes, and the pressurized fuel is introduced into a fuel rail 113. The quantity of fuel introduced into the fuel rail 113 is adjusted by means of a spill valve 108.

Electricity passing through a coil 110 causes the spill valve 108 to rise and overcomes a spring 111, thereby opening a valve 109. When the valve 109 opens, the pressure chamber 118 is communicated to the fuel intake side. Thus, the fuel returns to the fuel intake side without being sent to the fuel rail 113. Therefore, the fuel is not discharged from the pump to the fuel rail 113.

When fuel pressure inside the fuel rail 113 reaches the valve-opening pressure for a relief valve 114, the relief valve 114 opens, and the fuel in the fuel rail 113 returns to the fuel tank 101. A fuel pressure sensor 116 detects the fuel pressure inside the fuel rail 113, and sends this to an ECU 117, which thus performs feedback control and the like. The injector 115 directly supplies the pressurized fuel in the fuel rail 113 to the combustion chamber inside the internal combustion engine.

FIG. 2 shows the relationship between the pump cam 112 and a drive signal sent to the spill valve 108. Note that the rotation angle of the pump cam 112 is measured by means of a cam sensor 120 shown in FIG. 1. In FIG. 2, reference numeral 10 indicates how the diameter of the pump cam 112 changes in relation to the piston 107, and reference numeral 11 indicates changes in the drive signal. As shown in FIG. 2, when the pump cam 112 is ascendant, the piston 107 moves upward and thus the volume of the pressure chamber 118 decreases, whereby the fuel is compressed. In the case where the spill valve 108 driving signal is ON, the fuel is returned to the fuel intake side. Therefore, fuel is not discharged to the fuel rail 113. Even during the fuel discharge stroke, the spill valve 108 is closed only in the case where the drive signal to the spill valve 108 is OFF. Therefore, the discharge of the fuel to the fuel rail 113 side is effective. By controlling the spill valve ON/OFF periods, the effective pump discharge quantity is controlled to thereby control the fuel pressure.

The appropriate fuel pressure depends on the operating state of the engine. Typically, the fuel pressure varies within a range of approximately 3–12 Mpa. Depending on the fuel rail volume, for example, approximately 100 mcc of fuel is necessary to cause the fuel pressure to increase by 1 Mpa. In order to cause the fuel pressure to change by 9 Mpa, approximately 900 mcc of fuel must be introduced into the fuel rail. On the other hand, one pump cycle by a high-pressure pump can only pump out approximately 100 mcc of fuel at maximum. As such, in the case where the target fuel pressure is changed by a large amount, it is necessary to continue the maximum discharge over several cycles, in which the fuel which needed to be pumped out but could not be pumped out in one cycle is pumped out in the next cycle.

FIG. 10 explains control operations in the conventional fuel supply device shown in FIG. 1. In FIG. 10, the computed target fuel pressure, which varies with each engine operating state, is read at reference numeral 1001. At reference numeral 1002, the target fuel pressure from the previous cycle is computed. The difference between the target fuel pressure computed at reference numeral 1001 and the previous cycle target fuel pressure computed at 1002 is computed at reference numeral 1003 as a target fuel pressure difference. Next, at reference numeral 1004, the pump discharge quantity is computed from the target fuel pressure difference, using a predetermined correspondence map which is prepared in advance. At reference numeral 1005, a carry over quantity 1016 from the previous cycle, which will be described later, is added to the pump discharge quantity to compute the feed forward quantity. At reference numeral 1007, an injector injection quantity 1006, the feed forward quantity and a feedback correction quantity are added together to produce a total pump discharge quantity 1008. Here, the feedback quantity refers to a quantity computed at reference numeral 1014 by adding together a proportional gain 1010 and integral amounts which are given based on the difference between the target fuel pressure 1001 and actual fuel pressure 1008. Next, at reference numeral 1015, a pump one discharge quantity is computed from the total pump discharge quantity. At reference numeral 1018, the pump one discharge quantity is converted into a spill valve control angle 1019. Note that at reference numeral 1017 the pump one discharge quantity is subtracted from the total pump discharge quantity, and the remainder becomes the carry over quantity 1016 for the next cycle.

Explanation will now be made of the operations, using the flow chart shown in FIG. 9. The target fuel pressure (FPt), which varies depending on the engine operating state, is computed at step S801. At step S802, the target fuel pressure difference (DPt) is computed based on the target fuel pressure (FPt) and the previous cycle target fuel pressure (FPt [i–1]). At step S803, the correspondence map is used to produce a target fuel pressure differential flow rate (Qt) from the target fuel pressure difference (DPt), for example. At step S804, the target fuel pressure differential flow rate (Qt) and the previous cycle's carry over quantity (Qcarry[i–1]) are added together to produce the feed forward quantity (Qff). At step S806, the feedback correction quantity (Qfb) is computed from the difference between the target fuel pressure (FPt) and the actual fuel pressure (FPd). At step S807, the feed forward quantity (Qff), the injection quantity (Qinj) and the feedback correction quantity (Qfb) are added together to computed the total pump discharge quantity (Qall). At step S808, the pump one discharge quantity (Qone) is computed on the basis of the total pump discharge quantity by setting a limit value therefor. At step S809, the pump one discharge quantity (Qone) is subtracted from the total pump discharge quantity (Qall) to produce the carry over quantity for the next cycle (Qcarry). The next cycle carry over quantity becomes the previous cycle carry over quantity (Qcarry[i−1]) when this computation process is performed in the next cycle. At step S810, the spill valve control angle is computed from the pump one discharge quantity to control the ON/OFF angle of the spill valve, whereby it is possible to control the pump discharge quantity and the fuel pressure.

In the conventional device described above, the feedback control is executed even though the feed forward control is being executed. Therefore, the feedback control is executed based on the difference between the target fuel pressure and the actual fuel pressure, while in a state where the feed forward control is being executed and the actual fuel pressure has not caught up with the target fuel pressure. Therefore, there was a problem that the feedback correction quantity deviates from a correct value, and further, when the feed forward control ends, the deviation of the feedback correction amount causes the actual fuel pressure to deviate from the target fuel pressure, thus generating an overshoot when the target fuel pressure is raised and an undershoot when the target fuel pressure is lowered.

SUMMARY OF THE INVENTION

The present invention has been made to solve the above-mentioned problems, and an object thereof is to provide a fuel supply device for an internal combustion engine, which is capable of preventing fuel pressure control problems caused by divergence of a feedback correction quantity in the pump control.

The present invention relates to a fuel supply device for an internal combustion engine, which includes: target fuel pressure computing means for computing a target fuel pressure based on an operating state of the internal combustion engine; fuel pressure detecting means for detecting actual fuel pressure; injector injection quantity computing means for computing an injection quantity by an injector; feed forward quantity computing means for computing as a feed forward quantity a pump discharge quantity calculated in accordance with an amount of change in the target fuel pressure that is computed by the target fuel pressure computing means; feedback correction quantity computing means for computing a feedback correction quantity based on the target fuel pressure and on the actual fuel pressure detected by the fuel pressure detecting means; and fuel pressure controlling means for controlling fuel pressure by controlling an angle of a spill valve based on the feed forward quantity, the injector injection quantity and the feed back correction quantity. In this fuel supply device, the computation of the feedback correction quantity by the feedback correction quantity computing means is stopped when the feed forward quantity is not within a given range. As such, the feedback control is stopped while the feed forward quantity (Qff) is not in the given range, which is to say it is stopped while the feed forward control is being performed. Therefore, it becomes possible to suppress undershooting/overshooting of the target fuel pressure by the actual fuel pressure following completion of the feed forward control.

DETAILED DESCRIPTION OF THE PREFERRED EMBODIMENTS

Embodiment 1

Figure 1:
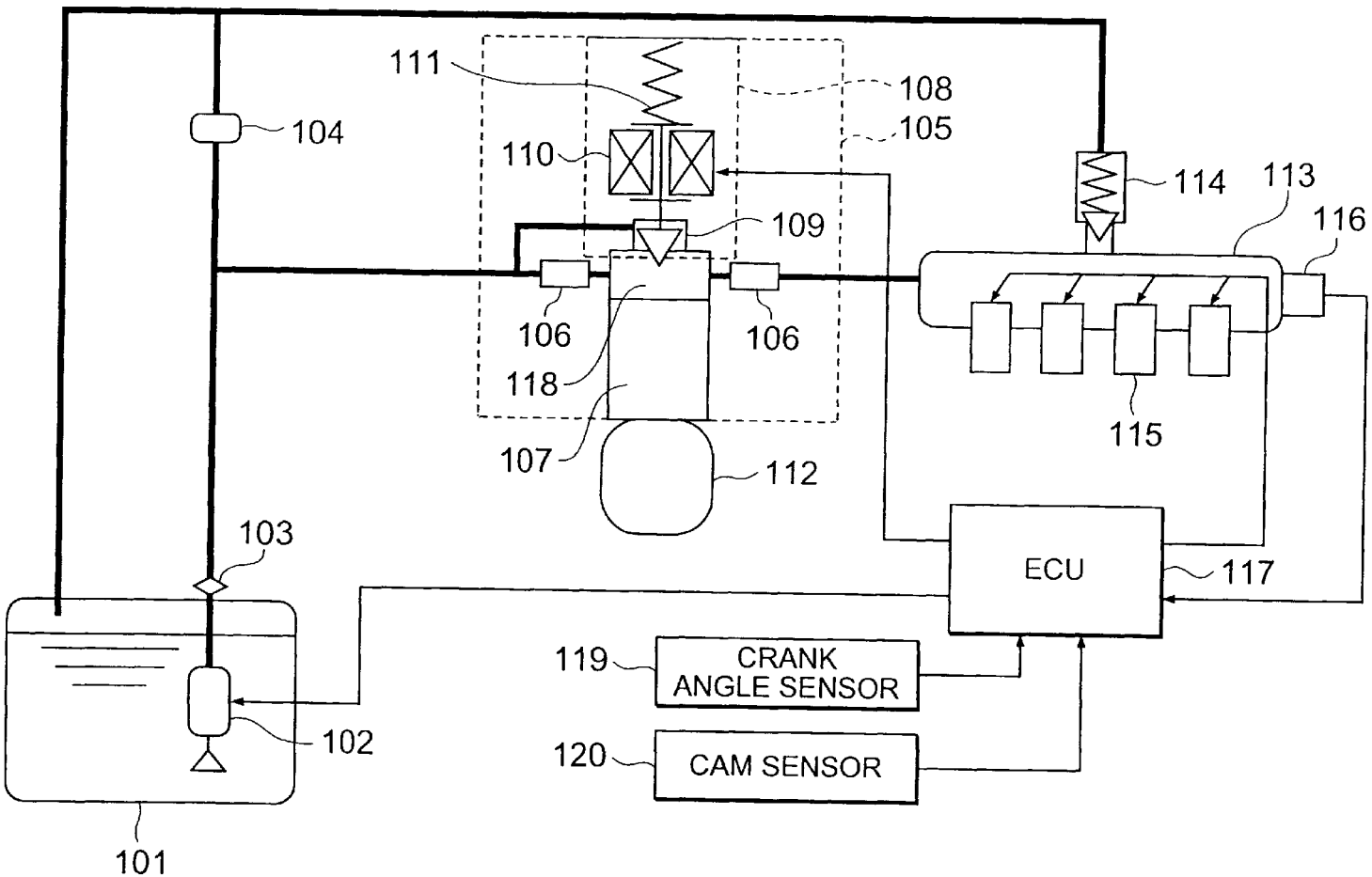
FIG. 1 is a configuration diagram showing a configuration of a fuel system in which is applied a fuel supply device for an internal combustion engine in accordance with the present invention.
Figure 2:
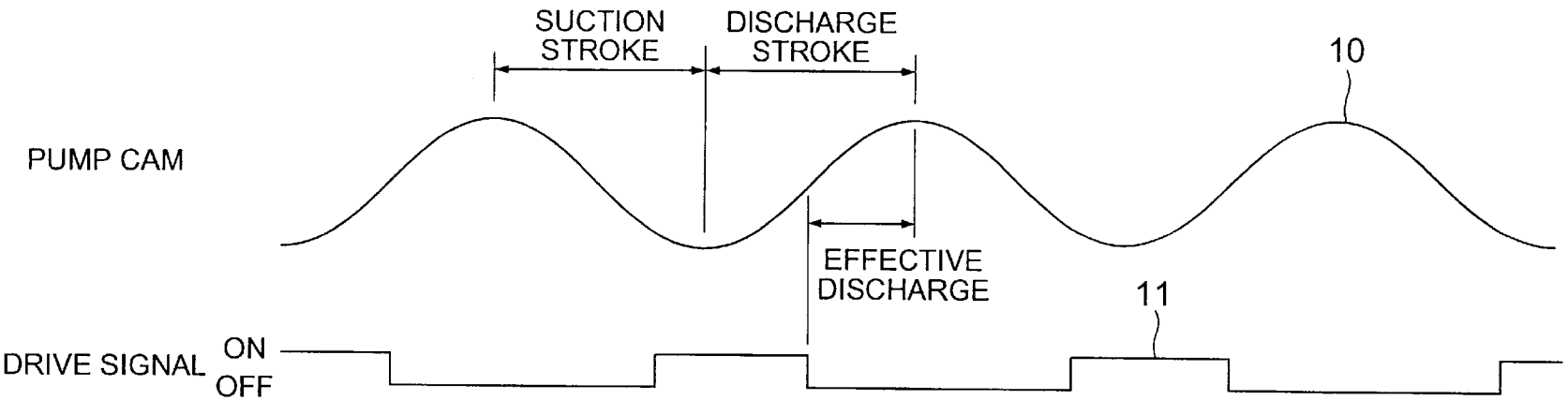
FIG. 2 is an explanatory graph for explaining a relationship between pump cam rotations and a drive signal for a spill valve, in accordance with the fuel supply device for an internal combustion engine according to the present invention.
Figure 8:
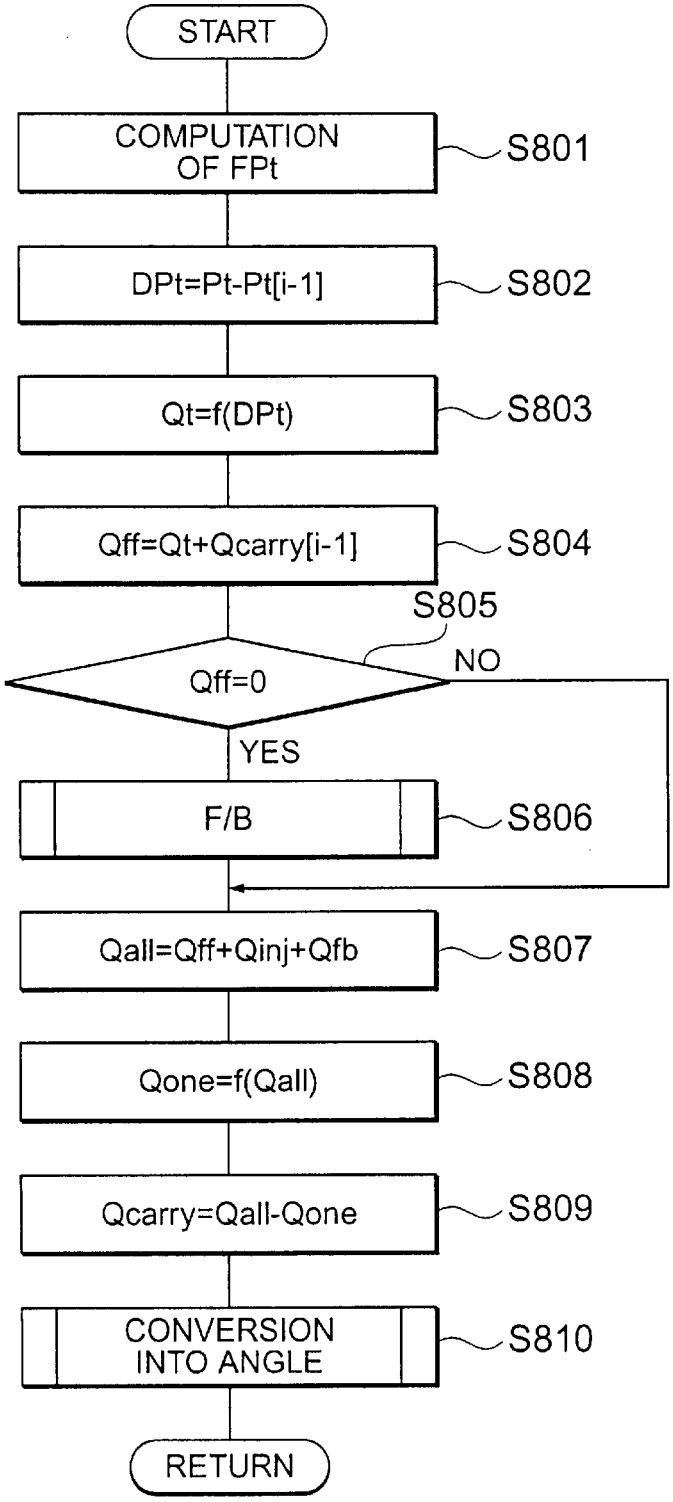
FIG. 8 is a flow chart showing operation of the fuel supply device for an internal combustion engine in accordance with Embodiment 1 of the present invention.
Figure 9:
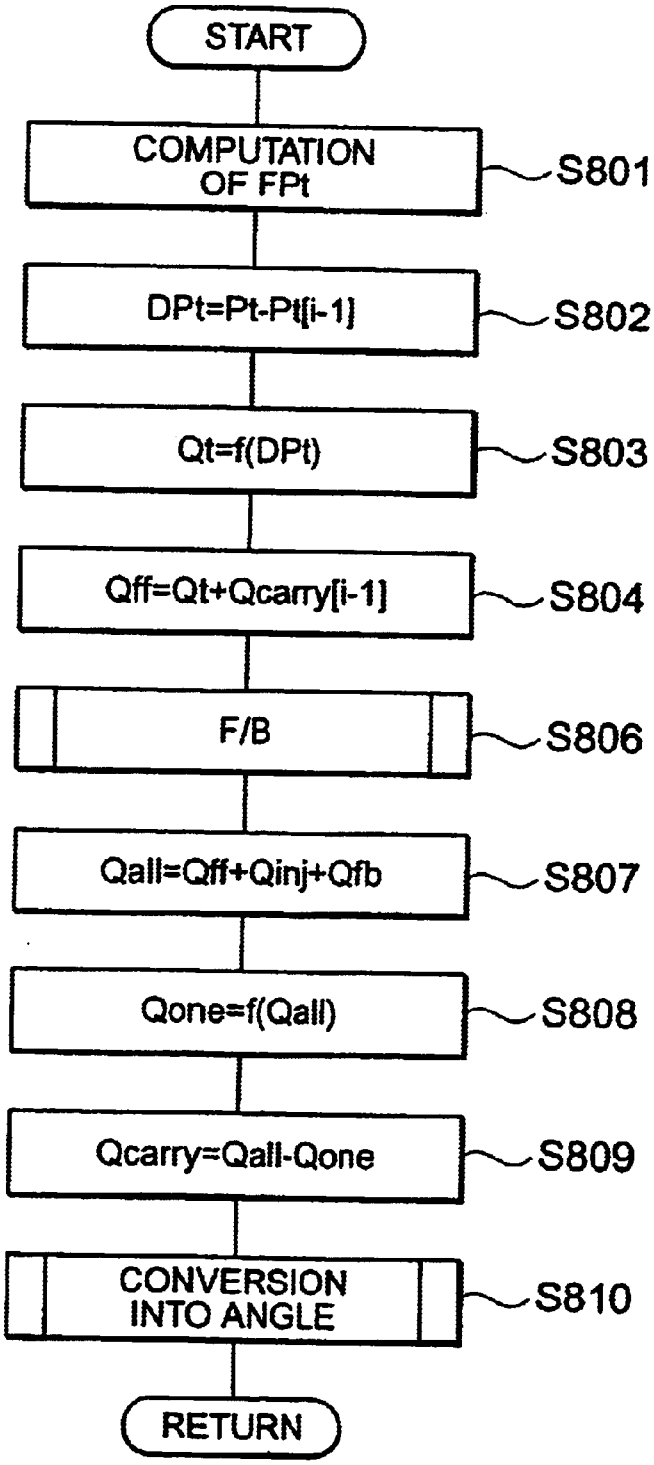
PRIOR ART FIG. 9
FIG. 9 is a flow chart showing operation of the conventional fuel supply device for an internal combustion engine.
Figure 10:
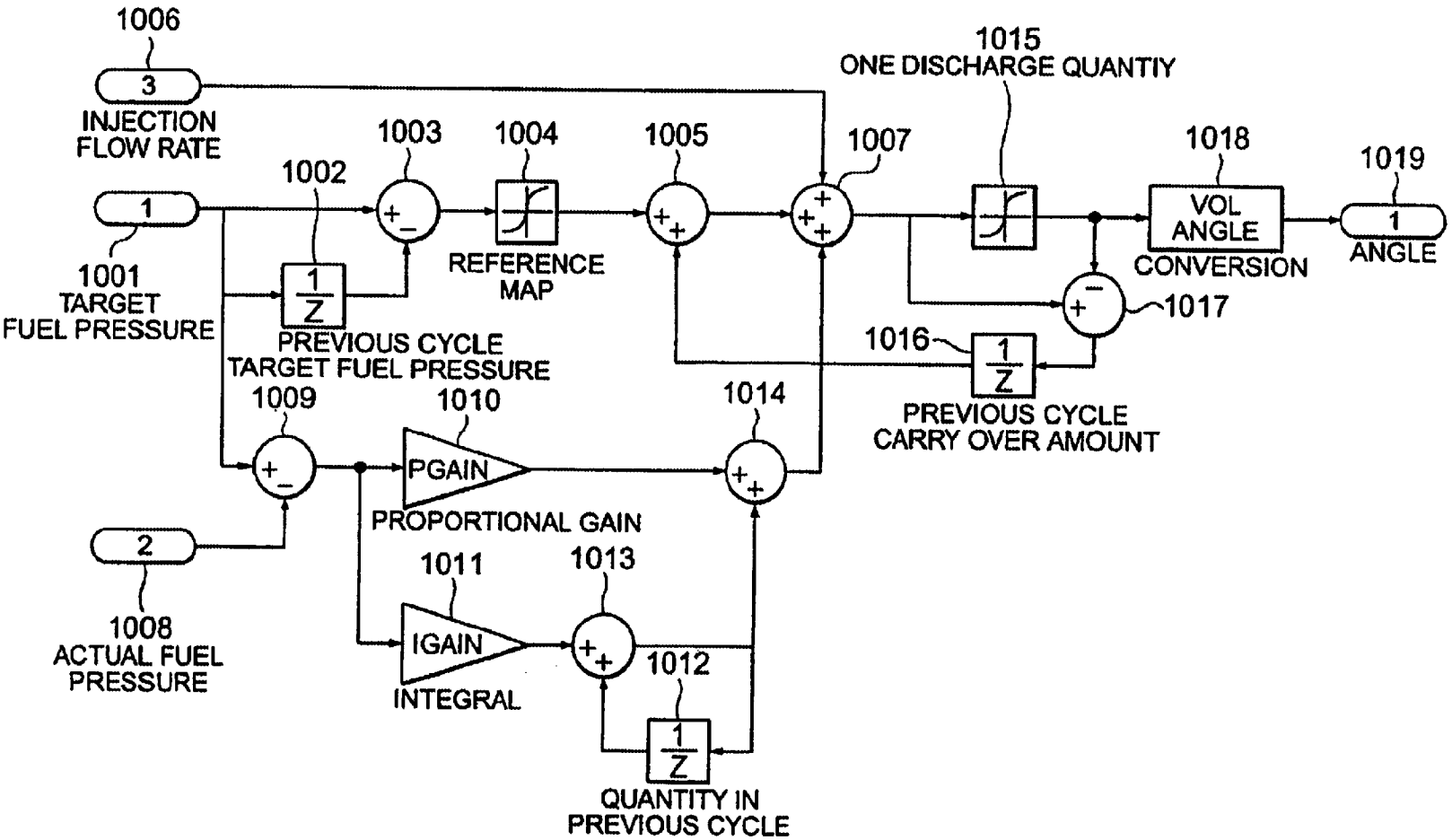
PRIOR ART FIG. 10
FIG. 10 is a control block diagram showing control operation in the conventional fuel supply device for an internal combustion engine.

The basic configuration of the fuel supply device for an internal combustion engine according to the present invention is similar to the one shown in FIG. 1. Therefore, explanation thereof is omitted, and explanation is made with focus on explanation of operations which are different from the conventional device. FIG. 8 is a flow chart showing operation of the fuel supply device of the present invention. First, the target fuel pressure (FPt), which varies depending on the operation states of the internal combustion engine, is computed at step S801. Next, at step S802, the target fuel pressure difference (DPt) (i.e., the amount that the target fuel pressure changed) is computed based on the target fuel pressure (FPt) and the previous cycle target fuel pressure (FPt[i−1]). At step S803, the target fuel pressure differential flow rate (Qt) is computed from the target fuel pressure difference (DPt), for example, using a predetermined correspondence map. At step S804, the target fuel pressure difference flow rate (Qt) and the previous cycle carry over quantity (Qcarry[i−1]) are added together to produce the feed forward quantity (Qff), which is the pump discharge quantity determined in response to the amount that the target fuel pressure is changed. At step S805 it is determined whether or not the feed forward quantity is zero. If it is not zero, operation advances to step S807 without performing the computation of the feedback correction quantity at step S806. If the feed forward quantity is zero, then the computation of the feedback correction quantity is performed at step S806. In the case where the computation of the feedback correction amount is performed, the value from the previous cycle is maintained as it is without updating it. At step S806, the feedback correction quantity (Qfb) is computed from the difference between the target fuel pressure (FPt) and the actual fuel pressure (FPd) detected by the fuel pressure sensor 116. Next, at step S807, the feed forward quantity (Qff), the injector injection quantity (Qinj) and the feedback correction quantity (Qfb) are added together to compute the total pump discharge quantity (Qall). Note that the injector injection quantity (Qinj) is computed from the amount of time that electricity is supplied to the injector 115 from the ECU 117, and from the actual fuel pressure (FPd). At step S808, the pump one discharge quantity (Qone) is computed on the basis of the total pump discharge quantity by setting a limit value therefor. At step S809, the pump one discharge quantity (Qone) is subtracted from the total pump discharge quantity (Qall) to compute the carry over quantity (Qcarry) for the next cycle. When the computation processing is performed at the next cycle, the next cycle carry over quantity (Qcarry) will serve as the previous cycle carry over quantity (Qcarry[i−1]). At step S810, the spill valve control angle is computed from the pump one discharge quantity to control the spill valve ON/OFF angle, whereby it is possible to control the pump discharge quantity and also the fuel pressure.

The feedback correction quantity is computed at step S806 only in the case where it is determined at step S805 that the feed forward quantity (Qff) is zero. In this case, when the internal combustion engine is in its steady state and a fluctuation in rpm occurs, for example, the target fuel pressure (FPt) changes, and there are instances where the operation cannot transfer over to the feedback control because the feed forward quantity (Qff) is set anew over and over again. Therefore, when the feed forward quantity (Qff) of step S805 is set as $Q1 \leqq Qff \leqq Q2$, even when the internal combustion engine is in its normal operation state the feed forward quantity (Qff) stays within a quantity equivalent to the amount that the target fuel pressure (FPt) changes due to the rotational fluctuation. Accordingly, it becomes possible to achieve the transition over to the feedback control. Here, Q1 and Q2 are set such that the feed forward quantity (Qff) set according to the change in the target fuel pressure (DPt) stays within the range between Q1 and Q2.

As described above, in accordance with the present embodiment, the feedback control is stopped when the feed forward quantity (Qff) is not at zero, which is to say that it is stopped when the feed forward control is being executed. This prevents the feedback control from being executed even when the actual fuel pressure is still following up the target fuel pressure in the feed forward control, which would cause the feed back correction amount to diverge. Therefore, it becomes possible to suppress the undershooting/overshooting of the target fuel pressure by the actual fuel pressure following completion of the feed forward control, whereby improving fuel pressure control problems.

Embodiment 2

The feed forward control described above is a control based on anticipation of probability. Explanation will now be made of an example in accordance with the present embodiment, in which data is set in a ROM (not shown in the diagram) of the ECU 117 to determine the necessary fuel quantity to make the fuel pressure respond appropriately for a predetermined target fuel pressure difference with a discharge quantity by a pump having specific characteristics (such as a main pump). The characteristics of the high-pressure pump and the capacity of the pipe capacity of the fuel rail vary widely depending on individual units, and when the characteristics of the high-pressure pump and the pipe capacity of the fuel rail vary, responsiveness in the fuel pressure naturally varies. Explanation will now be made of a method for controlling this variation in fuel pressure responsiveness.

Figure 3:
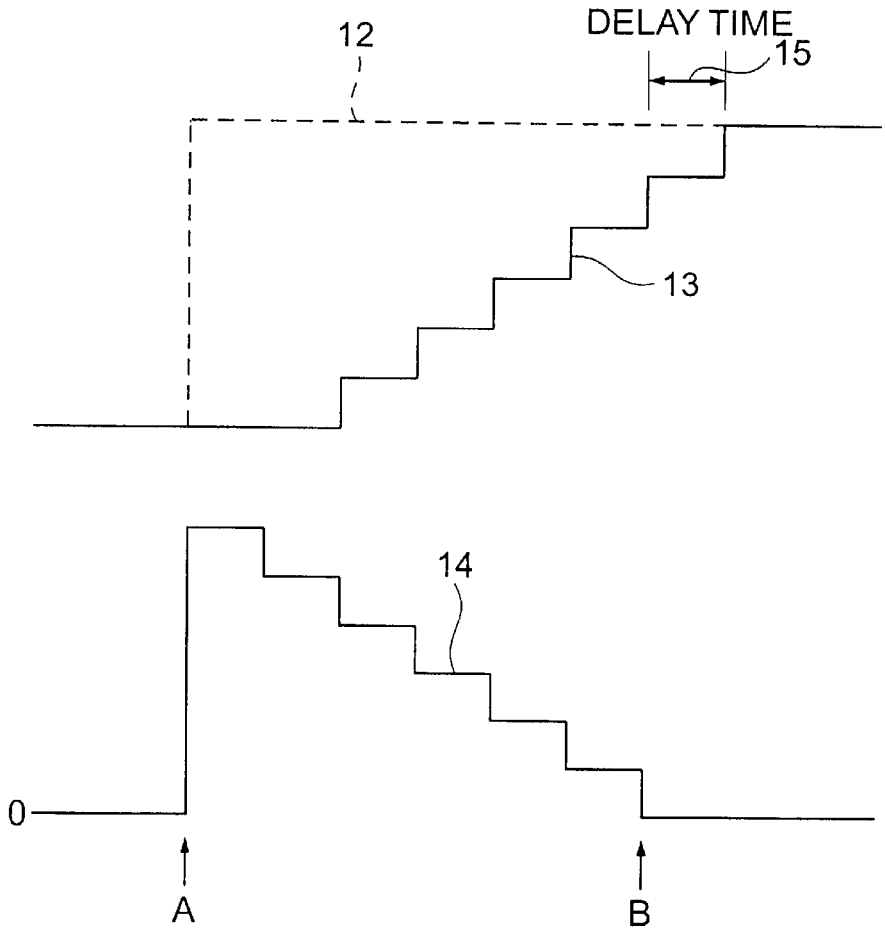
FIG. 3 is an explanatory graph for explaining a relationship among a target fuel pressure, an actual fuel pressure and a feed forward quantity, in accordance with the fuel supply device for an internal combustion engine according to the present invention.

FIG. 3 shows the case where the feed forward control quantity (Qff) 14 is the same as the fuel pressure change amount, which is determined by such factors as the pump discharge quantity and fuel rail pipe capacity. At a point in time A, when the target fuel pressure (FPt) 12 changes, the feed forward control quantity (Qff) 14 is set and then decreases little by little. The actual fuel pressure (FPd) 13 reaches the target fuel pressure (FPt) after the feed forward control quantity (Qff) 14 reaches zero at a point in time B, once a given delay time (reference numeral 15) passes.

Figure 4:
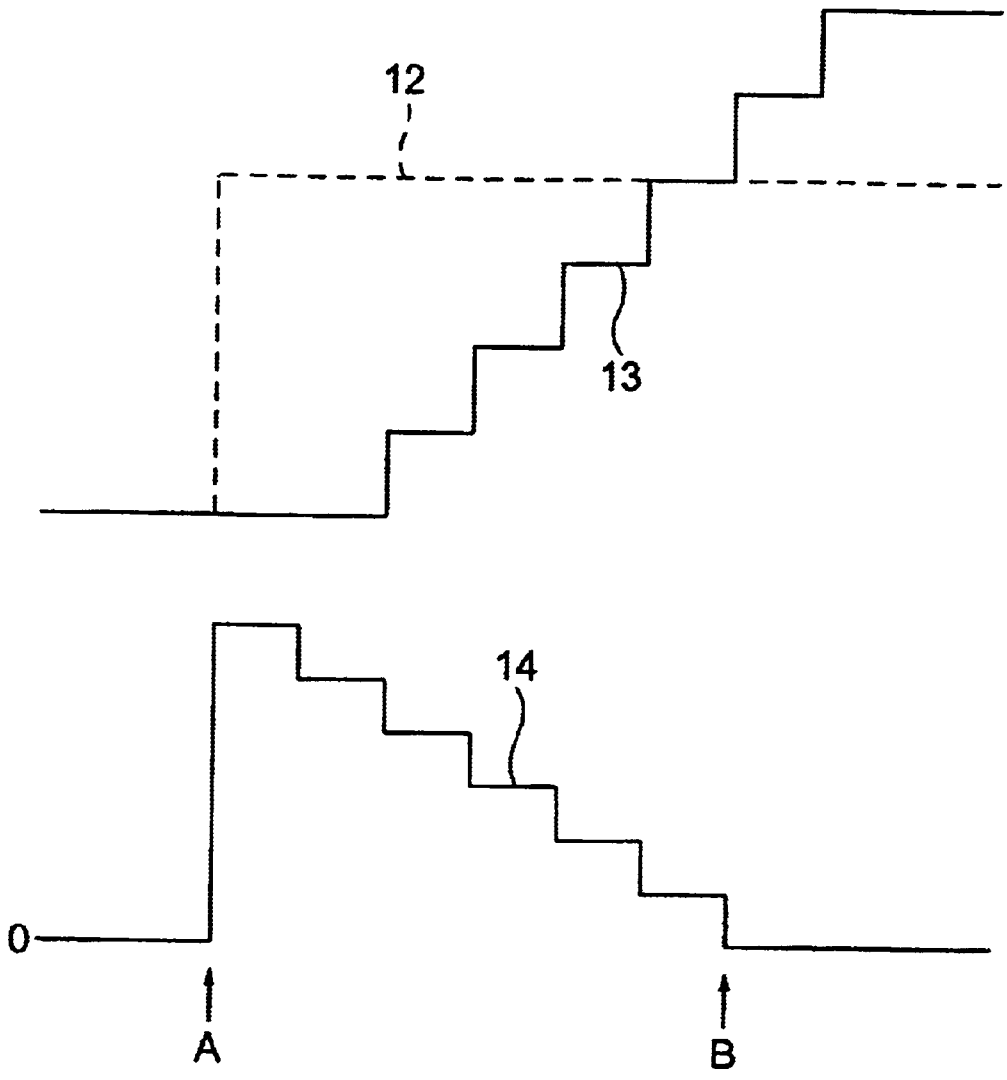
PRIOR ART FIG. 4
FIG. 4 is an explanatory graph for explaining a relationship among the target fuel pressure, the actual fuel pressure the feed forward quantity, in accordance with a conventional fuel supply device for an internal combustion engine.

FIG. 4 shows the case where the fuel pressure change amount is greater than the feed forward control quantity (Qff) due to large pump discharge quantity or due to small fuel rail piping capacity, for example. The target fuel pressure (FPt) 12 changes at point A, and when the feed forward quantity (Qff) becomes zero, the actual fuel pressure 13 exceeds the target fuel pressure 12, creating an overshoot. Since the feedback control is performed only after the feed forward quantity (Qff) 14 becomes zero, the amount that the actual fuel pressure overshoots the target fuel pressure 12 must be made to converge with the target fuel pressure by means of the feedback control. As such, the fuel pressure responsiveness deteriorates, and the fuel pressure is not optimum for the operating conditions of the engine at that time. Thus, exhaust gas and driveability problems are worsened.

Figure 5:
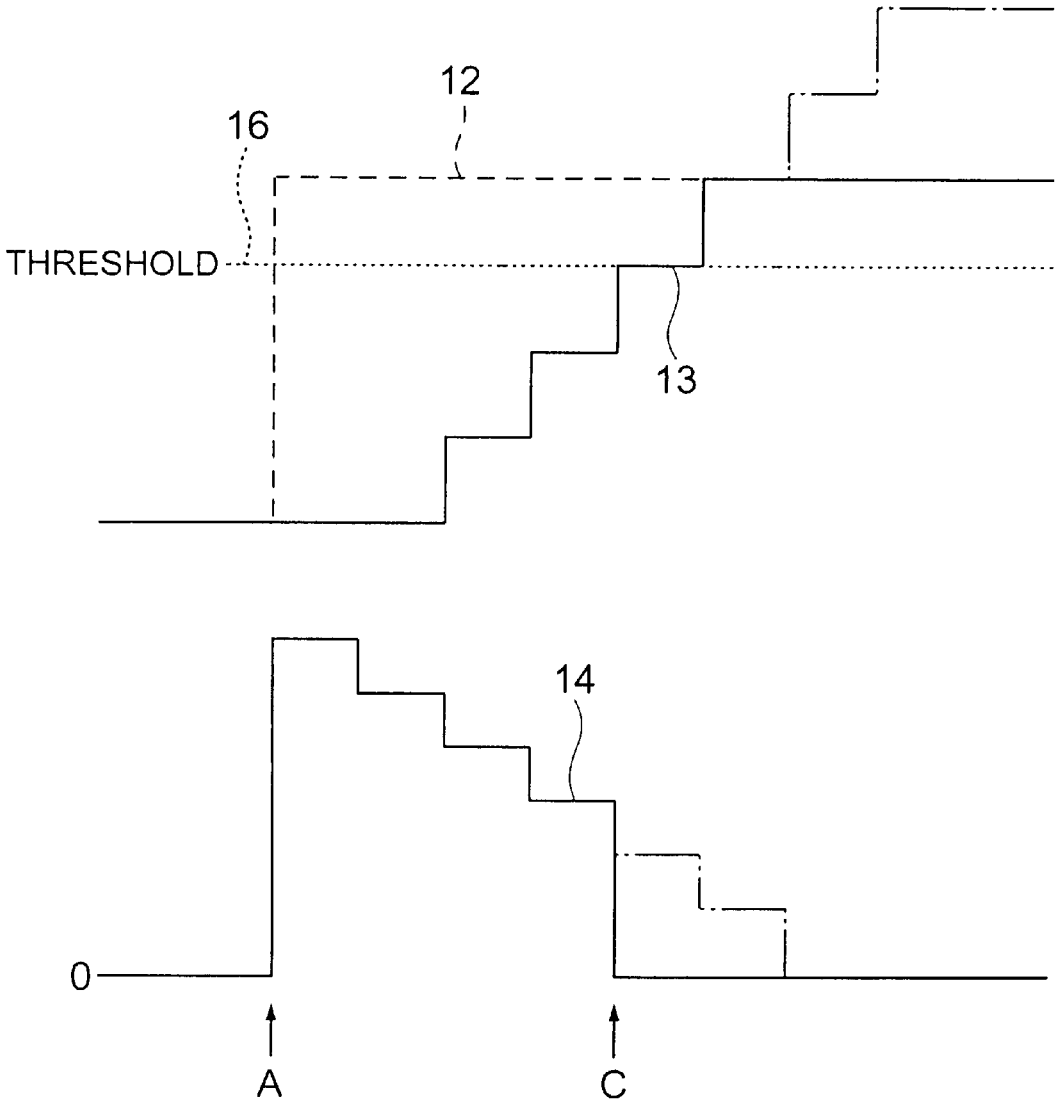
FIG. 5 is an explanatory graph for explaining a relationship among the target fuel pressure, the actual fuel pressure and the feed forward control, in accordance with a fuel supply device for an internal combustion engine fuel according to Embodiment 2 of the present invention.

FIG. 5 shows a method for improving the above-mentioned problem. When the target fuel pressure (FPt) 12 changes at point A and the feed forward quantity (Qff) 14 is set, the pump one discharge quantity is reduced with each discharge stroke. If the feed forward quantity (Qff) 14 is reduced down to zero, the operation becomes the one indicated by the single-dot line, which is the same as the operation shown in FIG. 4. However, when the difference between the actual fuel pressure 13 and the target fuel pressure 12 comes within a given fuel pressure difference (i.e., when the actual fuel pressure (FPd) exceeds a threshold value) at a point in time C, the feed forward quantity (Qff) 14 is reset back to zero. Accordingly, it becomes possible to prevent the actual fuel pressure (FPd) 13 from overshooting the target fuel pressure (FPt) 12. The amount of the given fuel pressure difference at which the feed forward quantity (Qff) 14 is reset, is equivalent to an amount that the fuel pressure is expected to have changed after a response delay time following stoppage of the feed forward control, which is a delay required for the actual fuel pressure (FPd) to respond to the stoppage of the feed forward control. This enables the actual fuel pressure (FPd) 13 to follow up target fuel pressure (FPt) 12 in an appropriate manner.

Figure 11:
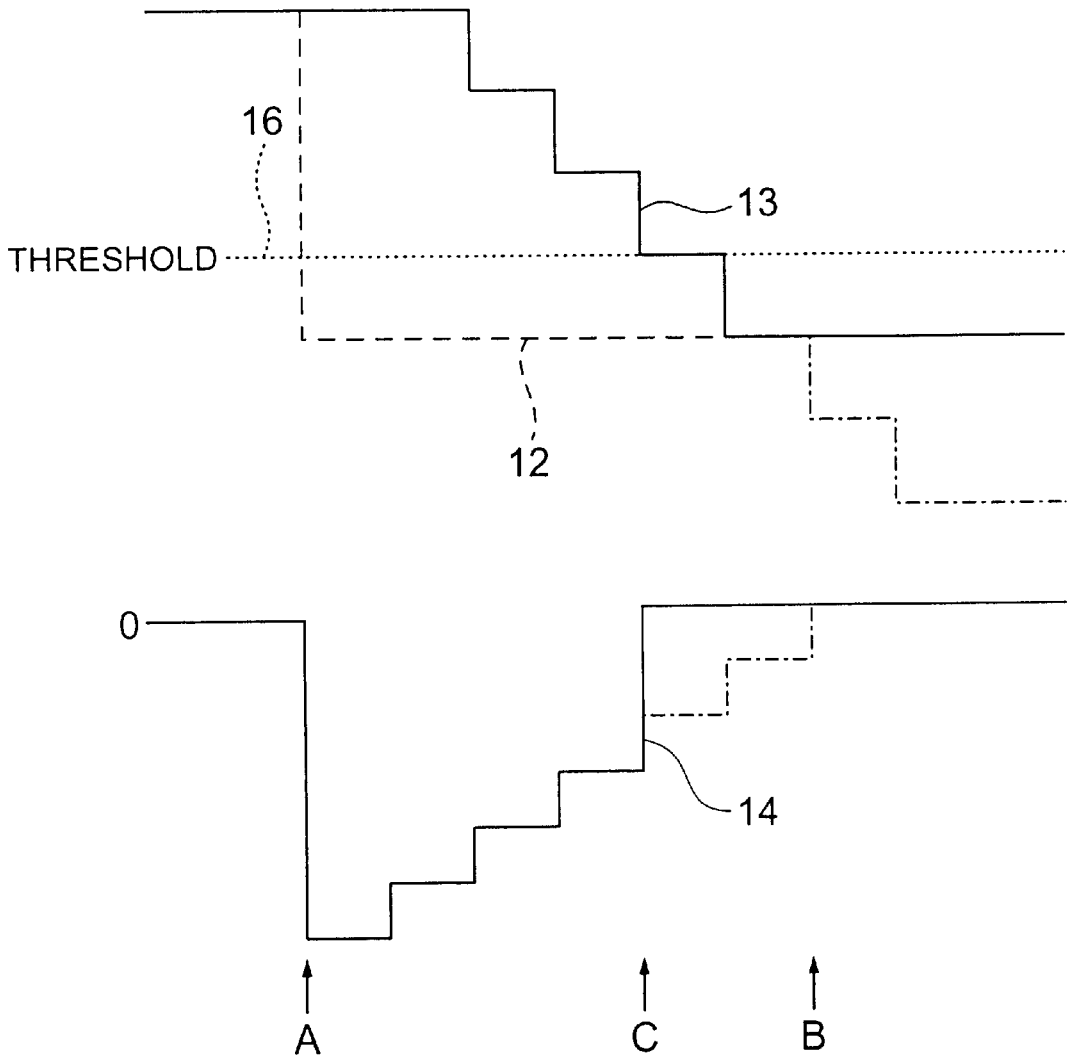
FIG. 11 is an explanatory graph for explaining the relationship among the target fuel pressure, the actual fuel pressure and the feed forward control, in accordance with the fuel supply device for an internal combustion engine according to Embodiment 2 of the present invention.

The case where the target fuel pressure 12 drops is similar to the above. That is, when the target fuel pressure (FPt) 12 changes at point A shown in FIG. 11, the feed forward quantity (Qff) 14 is set to a flow rate (i.e., an amount of fuel to be taken out from the fuel rail pipe) that is sufficient to enable the actual fuel pressure (FPd) 13 to follow up the target fuel pressure (FPt) 12 (in this case, a negative value is set). The fuel quantity in the fuel rail pipe decreases by the flow quantity that is to be injected by the injector. Therefore, the fuel pressure gradually decreases. However, if the injector flow rate which is actually injected is greater than the injector flow rate according to the data set in the ECU, then, when the feed forward quantity (Qff) 14 becomes zero at point B, the actual fuel pressure (FPd) 13 will fall below the target fuel pressure (FPt) 12. Therefore, also in the case where the target fuel pressure (FPt) 12 decreases, the feed forward quantity (Qff) 14 is reset to zero when the difference between the actual fuel pressure (FPd) 13 and the target fuel pressure (FPt) 12 comes within the predetermined range at point C. As a result, it becomes possible to suppress the undershooting of the target fuel pressure (FPt) 12 by the actual fuel pressure (FPd) 13. The given fuel pressure difference quantity at which the feed forward quantity (Qff) 14 is to be reset, is equal to a fuel pressure difference which the actual fuel pressure (FPd) can change within the delay time to reach the target fuel pressure (FPt) 12.

As described above, in accordance with the present embodiment, when the difference between the actual fuel pressure (FPd) 13 and the target fuel pressure (FPt) 12 comes within the given range which takes into account the anticipated response delay of the actual fuel pressure (FPd) 13, if the feed forward quantity (Qff) 14 is not zero the feed forward quantity (Qff) 14 is reset to zero. This prevents the actual fuel pressure (FPd) from overshooting or undershooting the target fuel pressure (FPt), and enables improvement of exhaust gas and driveability problems due to non-optimal fuel pressures at each operating state.

Embodiment 3

Figure 6:
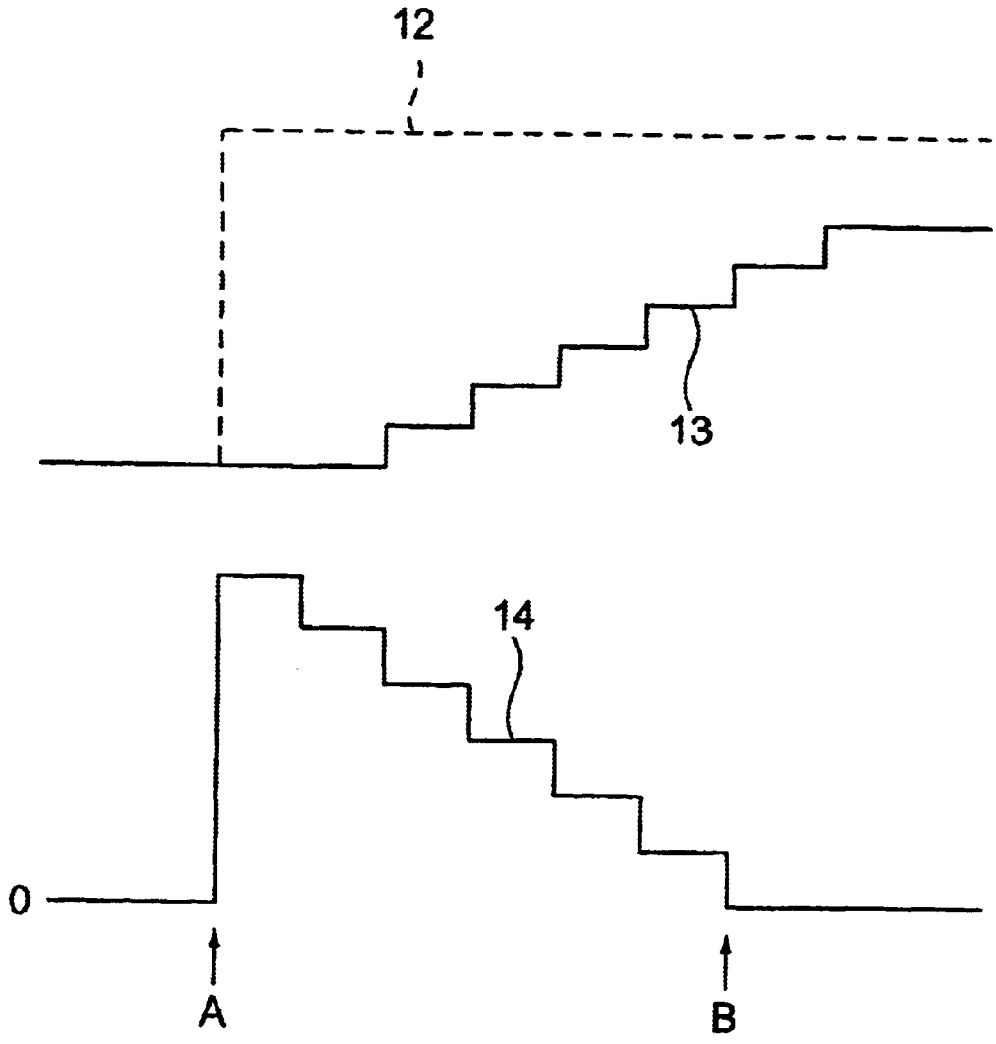
PRIOR ART FIG. 6
FIG. 6 is an explanatory graph for explaining a relationship among the target fuel pressure, the actual fuel pressure and the feed forward control, in accordance with a conventional fuel supply device for an internal combustion engine.
Figure 7:
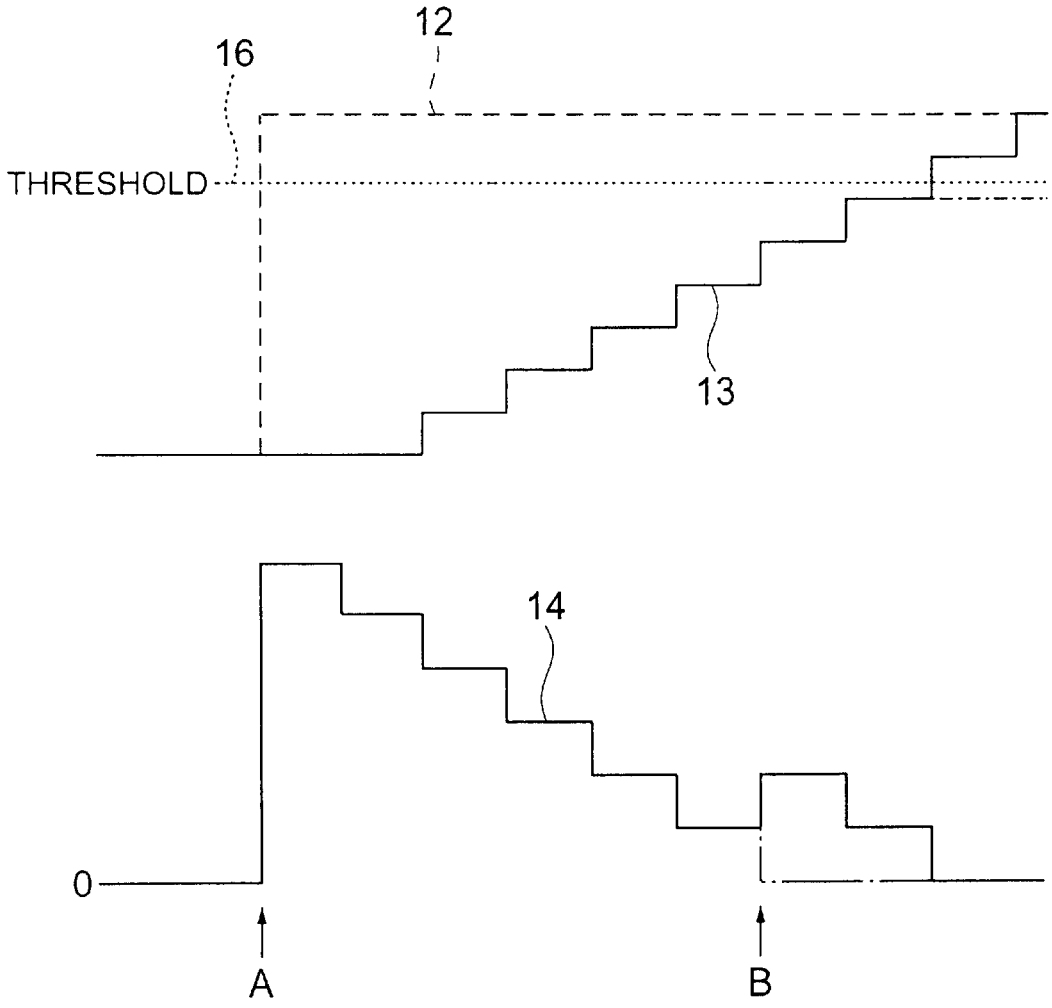
FIG. 7 is an explanatory graph for explaining a relationship among the target fuel pressure, the actual fuel pressure and the feed forward control, in accordance with the fuel supply device of an internal combustion according to Embodiment 2 of the present invention.

FIG. 6 shows a case where, opposite to the case of Embodiment 2 described above, since the pump discharge quantity is small or the fuel rail pipe capacity is large, for example, even when the feed forward control ends the actual fuel pressure (FPd) falls short of the target fuel pressure (FPt). FIG. 7 is an improvement over FIG. 6. The single-dot line in FIG. 7 indicates the case of FIG. 6. At a point in time B, even though the feed forward quantity (Qff) 15 has become zero, the actual fuel pressure (FPd) 13 falls short of the target fuel pressure (FPt) 12. On the other hand, in the case represented by the solid line, when the feed forward quantity (Qff) 14 becomes zero at point B and the difference between the actual fuel pressure (FPd) 13 and the target fuel pressure (FPt) 12 is equal or greater than a predetermined range (i.e., when the actual fuel pressure (FPd) has not exceeded a threshold value 16), then the feed forward quantity (Qff) 14 is set once again on the basis of the difference between the actual fuel pressure (FPd) 13 and the target fuel pressure (FPt) 12 at that point in time, thereby enabling the actual fuel pressure (FPd) 13 to follow up the target fuel pressure (FPt) 12 at a maximum speed.

Figure 12:
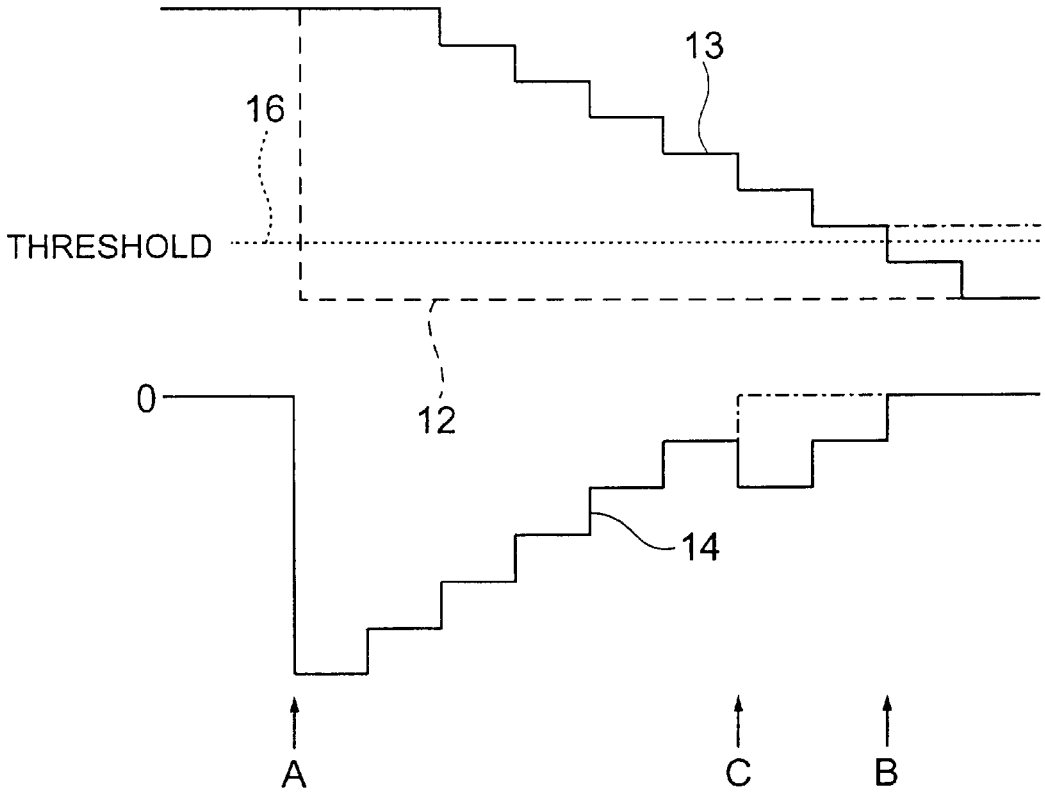
FIG. 12 is an explanatory graph for explaining the relationship among the target fuel pressure, the actual fuel pressure and the feed forward control, in accordance with a fuel supply device for an internal combustion engine according to Embodiment 3 of the present invention.

The case where the target fuel pressure (FPt) drops is similar to the above. As shown in FIG. 12, when the target fuel pressure (FPt) drops at point A, the feed forward quantity (Qff) 14 is set as a negative value, and upon each injection from the injector the injection quantity is added to the feed forward quantity (Qff) 14. In the case where the actual fuel pressure (FPd) 13 is greater than the target fuel pressure (FPt) 12 by a predetermined pressure value even when the feed forward quantity (Qff) 14 becomes zero at point C, then the feed forward quantity (Qff) 14 is set once again on the basis of the difference between the actual fuel pressure (FPd) 13 and the target fuel pressure (FPt) 12 at that time, and thus the feed forward control is continued.

As described above, in the present embodiment, in the case where the actual fuel pressure (FPd) 13 is lower than the target fuel pressure (FPt) 12 by the predetermined difference or more even when the feed forward quantity (Qff) 14 becomes zero, the feed forward quantity (Qff) is set again on the basis of the difference between the actual fuel pressure (FPd) 13 and the target fuel pressure (FPt) 12 at that time. As a result, the actual fuel pressure (FPd) 13 can smoothly follow up the target fuel pressure (FPt) 12, thereby enabling improvement of the exhaust gas and the driveability problems caused by the fuel pressure which is inappropriate for the engine's operating states.

Embodiment 4

Figure 13:
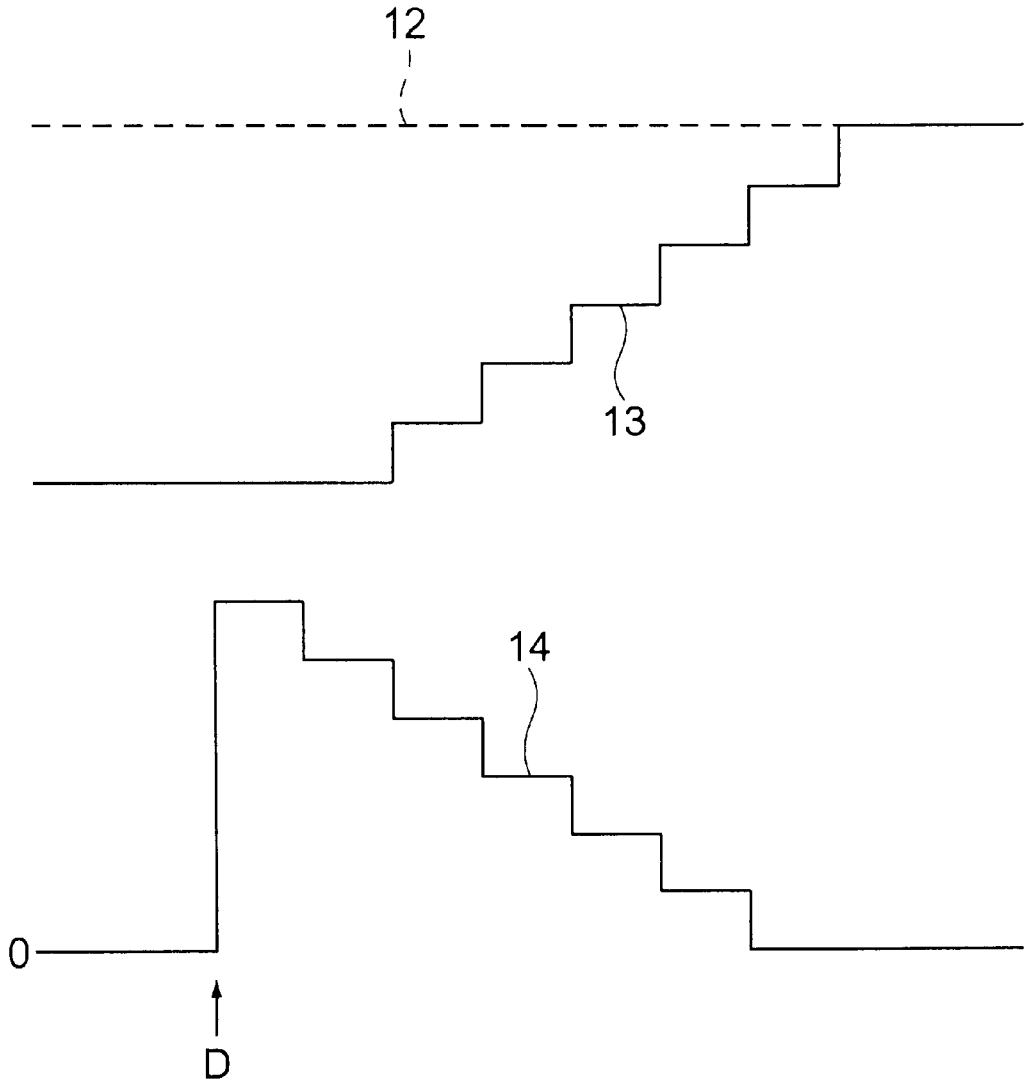
FIG. 13 is an explanatory graph for explaining a relationship among the target fuel pressure, the actual fuel pressure and the feed forward control, in accordance with a fuel supply device for an internal combustion engine according to Embodiment 4 of the present invention.

FIG. 13 depicts control at a time when the internal combustion engine is started. At the engine start time, the target fuel pressure (FPt) 12 is read out from data at a point in the correspondence map corresponding to the operating state at the time when the engine is started. While the engine is stopped, the fuel inside the fuel rail gradually leaves the fuel rail, thus causing the actual fuel pressure (FPd) 13 to drop. As a result, at the start time there is a difference between the actual fuel pressure (FPd) 13 and the target fuel pressure (FPt) 12. Therefore, at a point in time D, which is the start time, the feed forward quantity (Qff) 14 is set using the difference between the target fuel pressure (FPt) 12 and the actual fuel pressure (FPd) 13, thereby enabling the actual fuel pressure (FPd) 13 to follow up the target fuel pressure (FPt) 12 quickly.

As described above, in the present embodiment, at the start time the feed forward quantity (Qff) 14 is set using the difference between the target fuel pressure (FPt) 12 and the actual fuel pressure (FPd) 13, and the feed forward control is executed. As a result, the actual fuel pressure (FPd) 13 can be brought in line with the target fuel pressure (FPt) 12 extremely quickly even immediately after the engine is started, thus improving exhaust gas and driveability problems.

In the present invention, the fuel supply device for an internal combustion engine comprises: target fuel pressure computing means for computing a target fuel pressure based on an operating state of the internal combustion engine; fuel pressure detecting means for detecting actual fuel pressure; injector injection quantity computing means for computing an injection quantity by an injector; feed forward quantity computing means for computing as a feed forward quantity a pump discharge quantity calculated in accordance with an amount of change in the target fuel pressure that is computed by the target fuel pressure computing means; feedback correction quantity computing means for computing a feedback correction quantity based on the target fuel pressure and on the actual fuel pressure detected by the fuel pressure detecting means; and fuel pressure controlling means for controlling fuel pressure by controlling an angle of a spill valve based on the feed forward quantity, the injector injection quantity, and the feedback correction quantity. In the fuel supply device, the computation of the feedback correction quantity by the feedback correction quantity computing means is stopped when the feed forward quantity is not within a given range. As such, the feedback control is stopped while the feed forward quantity (Qff) is not in the given range, which is to say it is stopped while the feed forward control is being performed. As a result, the feedback control is prevented from being executed when the actual fuel pressure is still following up the target fuel pressure in the feed forward control, which would cause the feedback correction amount to diverge. Therefore, it becomes possible to suppress undershooting/overshooting of the target fuel pressure by the actual fuel pressure following completion of the feed forward control.

Further, when the difference between the actual fuel pressure and the target fuel pressure comes within a given fuel pressure difference, even when the feed forward quantity is not within the given range the feed forward quantity is reset to a quantity within the given range and operation switches over to the computation of the feedback correction quantity. As a result, the undershooting/overshooting by the actual fuel pressure can be suppressed, and exhaust gas and driveability problems due to the fuel pressure not being appropriate for each operating state can be improved.

Further, even when the feed forward quantity is within the given range, when the difference between the actual fuel pressure and the target fuel pressure is greater than the given fuel pressure difference the feed forward quantity is set again and feed forward control is continued. As a result, the actual fuel pressure can follow up the target fuel pressure 12 smoothly, thereby enabling improvement of the exhaust gas and the driveability problems caused by the fuel pressure which is inappropriate for the operating state of the internal combustion engine.

Further, the feed forward quantity is set again as the difference between the actual fuel pressure and the target fuel pressure. As a result, the actual fuel pressure can follow up the target fuel pressure 12 smoothly, thereby enabling improvement of the exhaust gas and the driveability problems caused by the fuel pressure which is inappropriate for the operating state of the internal combustion engine.

Further, the given range of the feed forward quantity, within which the feedback correction quantity computation is started, includes a range corresponding to a fluctuation amount occurring in the target fuel pressure due to rotation fluctuations, even when the internal combustion engine is in a steady state. As a result, it becomes possible the avoid a situation where operation cannot switch over to the feedback control due to rpm fluctuations and the like occurring during the steady engine state.

Further, the given fuel pressure difference is equal to an amount which the fuel pressure is expected to have changed after a response delay time caused by a response delay of the actual fuel pressure, following resetting of the feed forward quantity. As a result, the actual fuel pressure can follow up the target fuel pressure in an appropriate manner.

Further, when the internal combustion engine is started, the feed forward quantity is set as the difference between the target fuel pressure and the actual fuel pressure. As such, when the engine is started, the feed forward quantity is set as the difference between the target fuel supply and the actual fuel supply and the feed forward control is performed. As a result, the actual fuel pressure can be brought in line with the target fuel pressure quickly also immediately after the engine is started, thus enabling improvement of exhaust gas and driveability problems.

What is claimed is:

1. A fuel supply device for an internal combustion engine, comprising:

target fuel pressure computing means for computing a target fuel pressure based on an operating state of the internal combustion engine;

fuel pressure detecting means for detecting actual fuel pressure;

injector injection quantity computing means for computing an injection quantity by an injector;

feed forward quantity computing means for computing as a feed forward quantity a pump discharge quantity calculated in accordance with an amount of change in the target fuel pressure that is computed by the target fuel pressure computing means;

feedback correction quantity computing means for computing a feedback correction quantity based on the target fuel pressure and on the actual fuel pressure detected by the fuel pressure detecting means; and fuel pressure controlling means for controlling fuel pressure by controlling an angle of a spill valve based on the feed forward quantity, the injector injection quantity, and the feedback correction quantity, wherein the computation of the feedback correction quantity by the feedback correction quantity computing means is stopped when the feed forward quantity is not within a given range.

2. A fuel supply device for an internal combustion engine according to claim 1, wherein when the difference between the actual fuel pressure and the target fuel pressure comes within a given fuel pressure difference, even when the feed forward quantity is not within the given range the feed forward quantity is reset to a quantity within the given range and operation switches over to the computation of the feedback correction quantity.

3. A fuel supply device for an internal combustion engine according to claim 1, wherein even when the feed forward quantity is within the given range, when the difference between the actual fuel pressure and the target fuel pressure is greater than the given fuel pressure difference the feed forward quantity is set again and feed forward control is continued.

4. A fuel supply device for an internal combustion engine according to claim 3, wherein the feed forward quantity is set again as the difference between the actual fuel pressure and the target fuel pressure.

5. A fuel supply device for an internal combustion engine according to claim 1, wherein the given range of the feed forward quantity, within which the feedback correction quantity computation is started, includes a range corresponding to a fluctuation amount occurring in the target fuel pressure due to rotational fluctuations even when the internal combustion engine is in a steady state.

6. A fuel supply device for an internal combustion engine according to claim 2, wherein the given fuel pressure difference is equal to an amount which the fuel pressure is expected to change within a response delay time caused by a response delay of the actual fuel pressure, following resetting of the feed forward quantity.

7. A fuel supply device for an internal combustion engine according to claim 1, wherein when the internal combustion engine is started, the feed forward quantity is set as the difference between the target fuel pressure and the actual fuel pressure.

* * * * *